US005167565A

United States Patent [19]

Metcalf

[11] Patent Number: 5,167,565

[45] Date of Patent: Dec. 1, 1992

[54] INFANT'S CURIOSITY ARTICLE

[76] Inventor: Julie A. Metcalf, 3705 State Road 252, Martinsville, Ind. 46151

[21] Appl. No.: 824,713

[22] Filed: Jan. 17, 1992

Related U.S. Application Data

[63] Continuation of Ser. No. 626,943, Dec. 13, 1990, abandoned.

[51] Int. Cl.[5] ..... A63H 33/00

[52] U.S. Cl. ..... 446/491; 446/227; 5/482

[58] Field of Search ..... 446/491, 227, 71, 80, 446/26, 28, 327, 369; 5/482, 495, 485

[56] References Cited

U.S. PATENT DOCUMENTS

| | | | |
|---|---|---|---|
| 1,587,387 | 6/1926 | Lichtman | 5/482 X |
| 2,078,022 | 4/1937 | Roemer | 446/227 |
| 2,593,218 | 8/1952 | Swain | 446/28 X |
| 3,120,721 | 2/1964 | Bukatman et al. | 446/71 |
| 3,308,479 | 3/1967 | Sesco, Jr. | 446/28 X |
| 4,138,745 | 2/1979 | Greenspan | 446/327 X |
| 4,968,279 | 11/1990 | Smith | 446/71 |

FOREIGN PATENT DOCUMENTS

| | | | |
|---|---|---|---|
| 2197592 | 5/1988 | United Kingdom | 446/147 |

*Primary Examiner*—Mickey Yu
*Attorney, Agent, or Firm*—Woodard, Emhardt, Naughton, Moriarty & McNett

[57] ABSTRACT

An infant's curiosity article having a receiver body which has attached to its outer surface or surfaces a plurality of small attractor bodies which are spaced in a discrete arrangement on the receiver body; and the receiver body and the attractor bodies, and their atachment, are such that unless a certain attractor body is being manipulated by the infant the respective attractor body lies along the receiver body, but the infant can manually and easily move the respective attractor body or bodies away from the receiver body to provide a relatively more three dimensional appearance of the moved attractor(s) body and receiver body.

5 Claims, 1 Drawing Sheet

INFANT'S CURIOSITY ARTICLE

This application is a continuation-in-part, of application Ser. No. 07/626,943, filed Dec. 13, 1990.

FIELD OF THE INVENTION

The present invention relates to infants' articles, and more specifically to articles which are useful as being attractive to even very young infants.

Even more particularly, the invention relates to infants' articles whose attractiveness to the infants is that of both visual and tactile sensation.

The field of the present invention is further indicated and defined as to its concepts and effects by the prior art from "baby blankets" down to pacifiers, as might be reasonably considered as having curiosity-challenging nature, and being types of infant's articles; but even an innumeration of even the types of all such varieties of articles would be so voluminous, and since objects of these various types of baby articles or infant articles are so well known to parents, the whole world over, that herein the relation to the field of this invention and the prior art in the field seems desirably kept to that of what seems closest to the present invention, i.e., in summary form, a blanket-like receiver body of a nature to provide novel curiosity-arousing effects for an infant.

SUMMARY OF THE INVENTION

The invention provides, in its preferred form herein set forth, a small blanket as a receiver body; and a plurality of tag-like portions of cloth or similar material of attractive or curiosity-challenging nature, herein called "attractors" for want of a better name, are attached to the receiver body surface or surfaces in a spaced arrangement.

The attachment of the attractor to the receiver body, and their cloth or cloth-like nature, is such that unless manipulated by the infant, each of the respective attractor bodies will lie generally along the surface of the receiver body, in a relatively two dimensional nature of the composite assembly of receiver body and attractor(s), but permit the infant to easily move each of the attractor bodies away from the receiver body to provide a relatively more three dimensional appearance of the moved attractor body or bodies and receiver body.

The present invention thus provides for an infant the hopeful fascination of various devices, from a pacifier to an overhead mobile, or other curiosity-stimulating device which gives an entertainment to an infant.

The attractors can be of various designs, indicia, or sets; and hopefully the appeal of the article and of its movable attractors, coupled with the security feeling of the receiver body as a blanket, will provide a curiosity challenge or fascination to the infant.

THE PRIOR ART, AND ITS SHOWING OF INVENTIVENESS HERE

The prior art as to "baby blankets" is readily conceded to exist which, if provided with the particular combination concepts of the present invention, could be used in articles of the present invention; and the same condition as to the lack of the prior art as to the combination can be said as to prior art blankets with cloth areas sewn onto the blanket's surface, even baby blankets whose attached cloth areas (such as ears of an animal design) are movable off or away from the blanket's surface, and are somewhat spaced in accordance with the shape of the entire animal.

Moreover, as to a set of colored objects as being apparently quite attractive to an infant, this also is conceded.

However, all such prior art does not show or suggest the vital basic concept here, i.e., the vital combination of a plurality of attractor bodies, attached to a blanket body in a discrete or spaced arrangement, independent of the quantity such as the two ears of an animal, and independent of the spacing of features of a background design, with an optional use of a variety of sets for hopeful extra curiosity or fascination of the infant, as specified herein.

In contrast to the present invention's economical achievement of a curiosity-challenging combination here of randomly scattered attractors on a blanket body, the trend of the prior art seems to go to the less economical and more complex curiosity raisers, such as mobiles.

Moreover, the motivation of the prior art as to providing an infant's curiosity article can hardly be denied, for infant attendants are all surely very keenly aware of the need for more and different articles to pacify the infant being attended.

Thus it is to be seen that several factors of consideration of the massive and highly competitive prior art of infants' playthings, and more particularly a realistic consideration of the departure of the present concepts from the prior art, that emphasizes the inventive nature of the concepts here presented.

Accordingly, although various concepts relating to infants' articles are conceded and emphasized to have been known and used in the prior art, nevertheless, the prior art not having had the particular combination of concepts and details as here presented, and shown as a novel combination different from the prior art and its suggestions, even only a fair amount of realistic humility, to avoid consideration of this invention improperly by hindsight, requires the concepts and achievement here to be realistically viewed as a novel combination, inventive in nature. And especially is this a realistic consideration when viewed from the position of a person of ordinary skill in this art at the time of this invention, and without trying to reconstruct this invention from the prior art without use of hindsight toward particulars not suggested by the prior art of all relevant fields.

BRIEF DESCRIPTION OF THE DRAWINGS

The above description of the novel and advantageous invention is of somewhat introductory and generalized form. More particular details, concepts, and features are set forth in the following and more detailed description of an illustrative embodiment, taken in conjunction with the accompanying drawing, which is of somewhat schematic and diagrammatic nature, for showing the inventive concepts.

DETAILED DESCRIPTION OF ILLUSTRATIVE EMBODIMENT

As shown in an illustrative embodiment, the concepts provide an infant's curiosity article 10, hopefully of an attractiveness and intrigue to an infant.

Figure 1:
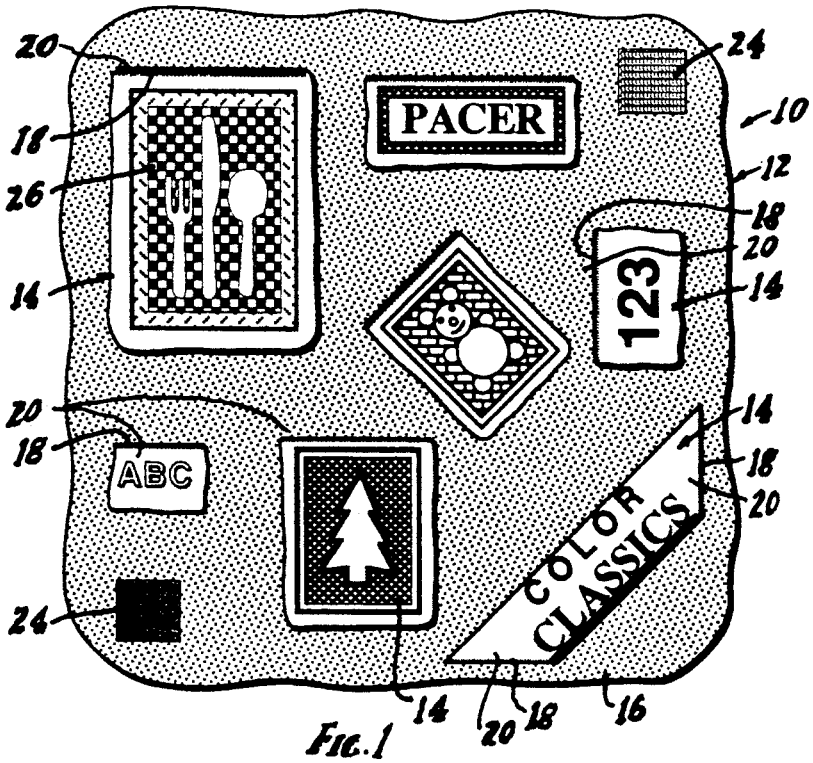
FIG. 1 is a plan view of an infant's curiosity article of the present invention, with a plurality of the attractor bodies sewn to a receiver body.

The novel combination has a receiver body 12, and a variety of attractor bodies 14; and although these primary components are illustrated in FIG. 1, it is the side elevation views (FIGS. 2 and 3) which best indicate the special concept of the limited nature of their interconnection described in detail herein.

Figure 2:
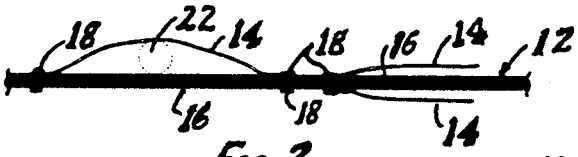
FIG. 2 is a side elevation view thereof, in somewhat enlarged scale, and illustrating the concept of having an attractor body on both sides of the receiver panel.
Figure 3:
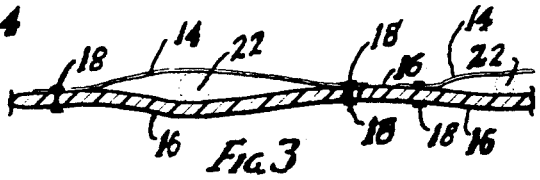
FIG. 3 is a side elevation view similar to FIG. 2, but illustrating a different nature of receiver panel and surface texture.

It will be noted that the receiver body 12 has a surface 16 which is of a relatively two-dimensional nature as FIGS. 2 and 3 illustrate. That is, unless the receiver 12 would be bent, which may be done to a soft blanket-like textured receiver 12 in a preferred embodiment of receiver 12, any significant amount of curiosity-providing portion of the overall article 10 will be by one or more of the attractors 14.

More particularly, there is provided a plurality of attractor bodies 14, each of which is of much smaller size than the receiver body 12. And most significantly each of the attractor bodies 14 is attached to the receiver body 12 by attaching means 18 which are provided at no more than two attaching portions 20 of the respective attractor body 14, for reasons of providing interest to the infant, and giving more conversation-factors for the infant's attendant to entertain the infant and/or to develop the infant's curiosity and interest in the things around him.

It is also quite significant that the remainder of each attractor body 14 is non-attached to the receiver body 12 except through the attaching means 18, here shown as the stitching 18, permitting the infant to easily, and with a very small amount of force, move any attractor body 14 away from the receiver body surface 16; and the attaching means 18 are located on the receiver body 12 in spaced locations, thus providing that the attractor bodies 14 are spaced in a discrete arrangement on the surface 16 of the receiver body 12.

Thus, it will be noted that each of the attaching means 18, and each of their respective attractor bodies 14, are such that, unless being manipulated by the infant's finger 22, the respective attractor body 14 lies generally along the surface 16 of the receiver body 12, and generally partaking of the generally two dimensional nature of the receiver body surface 16.

This is schematically illustrated in FIG. 2, in which the rightward attractor 14 on the upper face 16 of the receiver panel 12 lies generally along its surface 16; and also attractor 14 on the bottom face 16 of the receiver 12 is shown as already having been moved away from the receiver panel 12, providing a three-dimensional nature of the overall article 10, as to that particular attractor 14, emphasizing whatever is its particular design.

The easy movement of the attractor bodies 14 away from the receiver body 12 provides a relatively more three-dimensional appearance and interest of the moved attractor body 14 and receiver body 12.

Additional interest is shown by the addition of co-operative Velcro-type fasteners 24, preferably as shown in opposite corners of the receiver 12 in FIG. 1.

The concepts are not limited to any particular indicia or design of the attractor bodies 14, and the drawings are illustrative.

Figure 6:
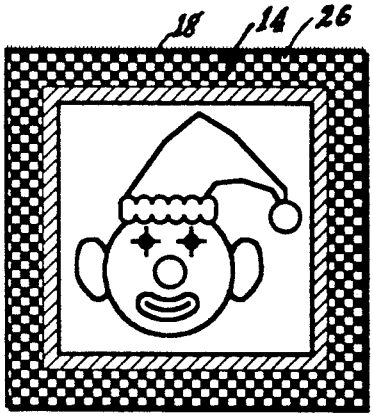
FIG. 6 is a plan view of another of the illustrative attractor bodies, and illustrating the use of a distinctive portion of two of the attractor being similar even though another distinctive portion of those attractor bodies is different. This view is in larger scale than the others.
Figure 5:
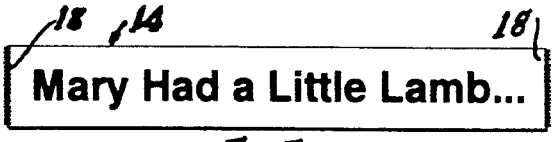
FIG. 5 is a view of another of the illustrative attractor bodies, with FIG. 5 (as does FIGS. 2 and 3) illustrating the concept of sewing the attractor body at two spaced locations.

Preferably, a plurality of attractors 14 are of a set, such as is illustrated by the similar backgrounds 26 of the FIGS. 1 and 6 attractors having the dinnerware set and the clown.

Also, variety is shown by FIG. 2, it showing an attractor body 14 on both faces 16 of the receiver member 12, as noted above.

Figure 4:
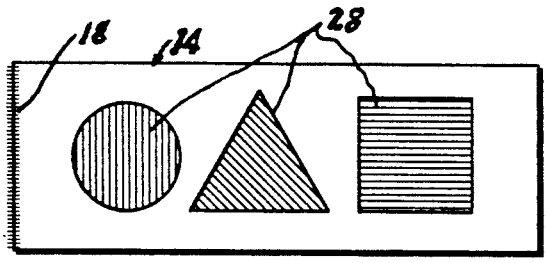
FIG. 4, in an enlarged scale, is a plan view of one of the attractor bodies.

Different colors are indicated by the variation of the attractor's design's lining 28 in FIG. 4.

CONCLUSION

It is thus seen that an infant's curiosity article, as provided and used according to the inventive concepts herein set forth, provides novel concepts herein set forth, provides novel concepts of a desirable and advantageous thing, yielding the advantages of a combination article of curiosity effect for an infant, having advantageous details and features, which, in overall combination, is conceptually different from the prior art articles even though various objects embodying certain of this article's details as a basic capability have, of course, been known for years; yet significantly this particular combination, even considered as including or building on prior art concepts, has not been suggested by the prior art, this achievement being shown herein as an advantageous departure from prior art, all this even though the prior art shows attempts at improvement and variations as to baby blankets and various types of articles hopefully having a fascination and/or curiosity-arousing effect on an infant. And particularly is the overall difference from the prior art significant when the non-obviousness is viewed by a consideration of the subject matter as a whole, as integrally incorporating a combination of features as different from the prior art, in contrast to merely those details of novelty themselves, and further in view of the prior art teaching away from the particular and inter-related concepts and features of the present invention.

In summary as to the nature of these advantageous concepts, their inventiveness is shown by novel features of concept and construction shown here, in novel and advantageous combination, not only being different from all the prior art known, but because the achievement is not what is or has been suggested to those of ordinary skill in the art, especially realistically considering this as comprising components which individually are similar in nature to what is well known in the arts of manufacture and use of pacifiers, blankets, and other prior art articles used by infants, for many years. No prior art has suggested the modifications of any prior art to achieve the novel concepts here achieved, with the various features providing their own functions in the overall combination; and this is particularly significant since these articles are objects whose details and effects are easy and apparent to observe, and are not technically sophisticated as to either construction, use, or operative principles.

Accordingly, it will thus be seen from the foregoing description of the invention according to this illustrative embodiment considered with the accompanying drawings, that the present invention provides new and useful concepts of a novel and advantageous combination, having and yielding desired advantages and characteristics in formation and use, and accomplishing the intended objects, including those hereinbefore pointed out and others which are inherent in the invention.

Modifications and variations may be effected without departing from the scope of the novel concepts of the invention; accordingly, the invention is not limited to the specific embodiments or form or arrangement of parts herein described or shown.

I claim:

1. An infant's curiosity article, comprising, in combination:

a receiver body, the receiver body having a surface which is of a relatively two dimensional nature, a plurality of attractor bodies, each of which is of much smaller size than the receiver body, there being permanent attaching means for each of the attractor bodies, the attaching means for each respective attractor body being provided to be of a limited length such as to provide a holding effect only at two attaching portions of each respective attractor body, each of the attractor bodies being thereby permanently attached to the receiver body by respective attaching means at two attaching portions of the attractor body and no more than two attaching portions of the receiver body, the remainder of each attractor body being non-attached to the receiver body except through the said attaching means, the attaching means being located on the receiver body in spaced locations, thus providing that the attractor bodies are spaced in a discrete arrangement on the receiver body, and each of the attaching means, and each of their respective attractor bodies, being such that unless being manipulated by the infant the respective attractor body lies generally along the surface of the receiver body, and generally partaking of the generally two dimensional nature of the surface of the receiver body, but the non-attached portion of the attractor body permits the infant, by just no more than extremely low manual force, to manually move each of the attractor bodies away from the receiver body to provide a relatively more three dimensional appearance of the moved attractor body and receiver body but with the attaching means permanently holding the respective attractor body to the receiver body.

2. The invention as set forth in claim 1, in a combination in which the attractor bodies include a related set.

3. The invention as set forth in claim 1, in a combination in which the receiver body is formed of cloth.

4. The invention as set forth in claim 2, in a combination in which the receiver body is formed of cloth.

5. The invention as set forth in claim 1, in a combination in which one or more attractor bodies, as mentioned above, and are attached to the receiver body as mentioned above, are provided on both faces of the receiver body.

* * * * *